United States Patent [19]

Poppe

[11] Patent Number: 4,612,869

[45] Date of Patent: Sep. 23, 1986

[54] ANCHOR SYSTEM

[75] Inventor: Horst Poppe, Hamburg, Fed. Rep. of Germany

[73] Assignee: Blohm & Voss AG, Hamburg, Fed. Rep. of Germany

[21] Appl. No.: 567,460

[22] Filed: Jan. 3, 1984

[30] Foreign Application Priority Data

Dec. 31, 1982 [DE] Fed. Rep. of Germany ..... 3248748

[51] Int. Cl.[4] ..... B63B 21/50

[52] U.S. Cl. ..... 114/293

[58] Field of Search ..... 114/200, 294, 293; 59/84, 93, 78, 78.1, 85, 31; 198/851, 853; 474/202, 206, 207

[56] References Cited

U.S. PATENT DOCUMENTS

| | | | |
|---|---|---|---|
| 3,969,949 | 7/1976 | Ohnishi | 59/31 |
| 3,970,733 | 7/1976 | Kraft et al. | 264/135 |
| 4,494,945 | 1/1985 | Ogino | 474/202 |

FOREIGN PATENT DOCUMENTS

| | | | |
|---|---|---|---|
| 3144728 | 5/1983 | Fed. Rep. of Germany . | |
| 1230157 | 9/1960 | France | 114/206 |
| 0030345 | 3/1979 | Japan | 59/78 |
| 0017782 | 2/1981 | Japan | 114/293 |
| 197 of 1859 | | United Kingdom | 59/78 |
| 1059247 | 2/1967 | United Kingdom | 59/78 |

OTHER PUBLICATIONS

Baldt, "Anchor/Mooring Systems for Berthing Systems", Copyright 1978.

*Primary Examiner*—Galen L. Barefoot
*Assistant Examiner*—Edwin L. Swinehart
*Attorney, Agent, or Firm*—Nils H. Ljungman

[57] ABSTRACT

An anchor system includes an anchor line having a first section proximate a floating structure, a second section proximate the anchoring ground or sea bed and an intermediate section comprising a sinker cable. The first and second sections are anchor chain comprising alternately disposed single link members and double link members pivotably interconnected with transverse bolts. The bolts are welded to the double link members and gaskets about the bolts are provided between the single and double link members to protect the portion of the bolt about which the single link member pivots. The anchor chain, proximate the floating structure, preferably includes anodes disposed to prevent corrosion. In another embodiment, the anchor chain is galvanized to inhibit corrosion.

12 Claims, 7 Drawing Figures

ANCHOR SYSTEM

FIELD OF THE INVENTION

The present invention relates to an anchor line carried by a floating structure. More particularly, the invention provides a combination chain and anchor line which is well suited for use by, but in no way limited to, offshore drilling platforms and construction, pipelaying and various other hull configurtions.

BACKGROUND OF THE INVENTION

Structures such as offshore drilling platforms are located at various locations in the ocean where they may be exposed to high sea states. It is necessary for such structures to be firmly anchored in order to avoid excessive lateral drift relative to a desired location. The anchoring structure used has typically comprised a substantial number of conventional anchors having flukes which dig into the anchoring ground and lengths of chain extending between each anchor and the floating structure. Because of the weight of the chain relative to its strength, this attachment means has limited the depth at which this anchoring technique can be employed. Wire rope, on the other hand, has better characteristics with respect to strength per unit length, but does not in and of itself, form a good suspension, interconnection member between the anchor and the floating structure. However, wire rope, when used alone, tends to impose upward forces on the anchor when unloaded.

It has been found preferable to utilize an anchor line comprising an anchor chain extending from the anchor and a wire rope extending from the opposite end of the anchor chain to the floating structure. The combination of wire rope and chain anchor line allows the maximum weight and holding power of the anchoring system to be concentrated at the end of the anchor line in contact with the anchoring ground or sea bottom with the lighter wire rope carrying the anchoring force between the floating vessel and the anchor chain.

While it is known to utilize a combination anchor chain and wire rope in forming an anchor line, certain drawbacks have been encountered and it is toward the correction of these drawbacks that the present invention is directed.

In the positioning of floating structures by means of combination anchor line systems of the general configuration described above, the anchor line system tends to take on a gradually curving profile or sag from the floating structure to the anchoring ground. As can be appreciated from the prior discussion, differing characteristics in the anchor line are demanded at various points along the entire anchor line. The use of a combination wire rope and anchor chain, for example, addresses the problem of criticality of length to weight ratio encountered in deep water anchoring. Unfortunately, the use of a combination anchor line, while solving one problem, lends itself to additional complications and drawbacks. Due to relatively large movements of the floating structure which take place, the portion of the anchor line proximate the structure is subjected to additional stress and the destructive effects of the harsh salt-air environment augmented by the salt spray as well as the movement of the chain in and out of the salt water. Thus, there is a significant danger of corrosion in the wet-dry zone proximate the surface of the ocean and the floating structure. It is a difficult task to weigh a portion of the anchor system in order to repair a section of the wire rope. Thus, another characteristic which is desirable in the wire rope and anchor chain combination for an anchor line system is strength, corrosive resistively and repairability at the portion of the anchor system proximate the floating structure and ocean surface.

Another desirable characteristic of deep water anchoring systems is a capacity to substantially resist the damaging effects of corrosion at the chain portion proximate the anchoring bed or sea floor.

It is, therefore, an object of this invention to provide an anchoring system which incorporates the features necessary to provide effective, long term deep water anchoring security.

It is another object of this invention to provide an anchoring system in which the section of the anchor system proximate the floating structure is substantially protected from the harsh environment of the salt spray and water.

It is still another object of this invention to provide an anchor system for long term, deep water anchoring which system lends itself to repairs when necessary in the event of corrosive damage to the anchor system proximate the floating structure.

It is yet another object of this invention to provide an anchoring system in which the chain portion of the system proximate the sea bed is substantially resistant to corrosion.

SUMMARY OF THE INVENTION

An anchor system includes an anchor line having a first section proximate a floating structure, a second section proximate the anchoring ground or sea bed and an intermediate section comprising a sinker cable. The first and second sections are anchor chain comprising alternately disposed single link members and double link members pivotably interconnected with transverse bolts. The bolts are welded to the double link members and gaskets about the bolts are provided between the single and double link members to protect the shank portion of the bolt about which the single link member pivots. The anchor chain, proximate the floating structure, preferably, includes anodes disposed to prevent corrosion. In another embodiment, the anchor chain is galvanized to inhibit corrosion.

BRIEF DESCRIPTION OF THE DRAWINGS

The above, as well as other features and advantages of the present invention, will become apparent through consideration of the detailed description in connection with the accompanying drawings in which.

DETAILED DESCRIPTION OF THE INVENTION

Figure 1:
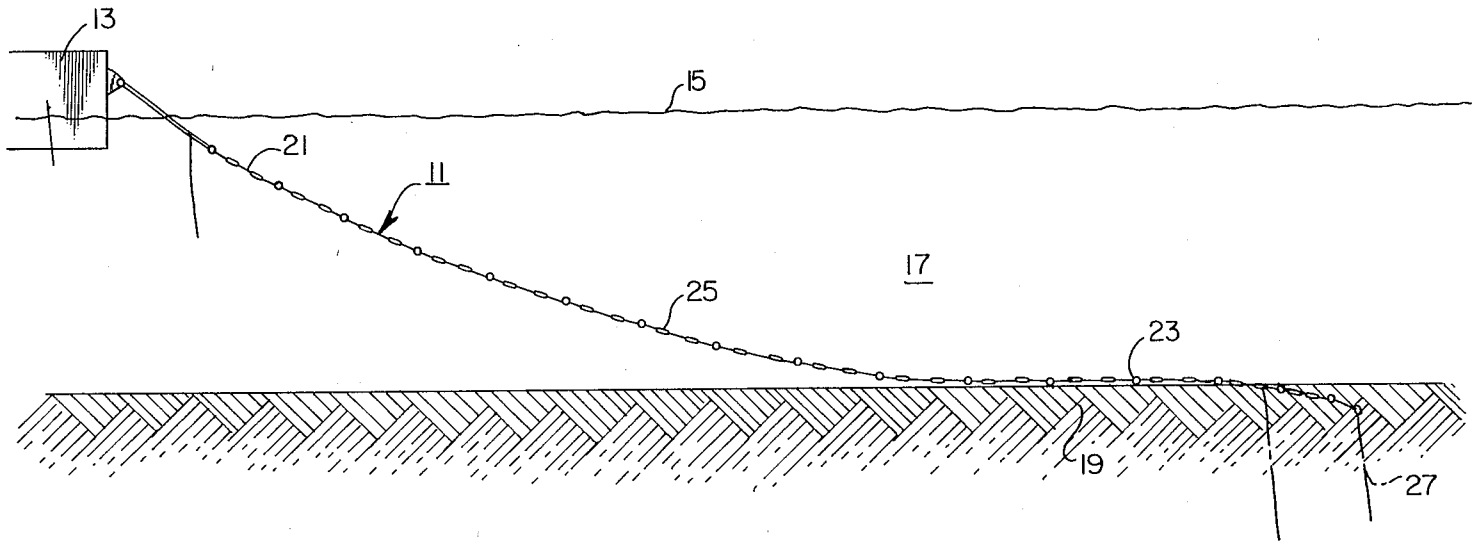
FIG. 1 is a somewhat schematical representation of an improved anchoring system according to the teaching of this invention.

The anchor line system of this invention is particularly well suited for use in a deep water anchoring applications. Considering FIG. 1, a metal anchor line system, generally indicated by the reference character 11 is shown securing a floating structure 13 at the surface 15 of a body of water 17 to the sea bed or anchoring ground 19. The anchor line system 11 can be viewed as having three distinct subsystems or sections, a first section 21 proximate the floating structure 13 and the water's surface 15, a second section 23 proximate the anchoring ground 19 and an intermediate section 25 thereinbetween. Typically, this intermediate section 25 is a sinker cable of the type described in Federal Republic of Germany Patent application No. P 31 44 728 published May 19, 1983, having the same inventor as the present application. Generally, sinker cables comprise a series of interconnected weights each of which may be several tons or greater in weight. The weights are typically connected by wire rope or chain.

Figure 4A:
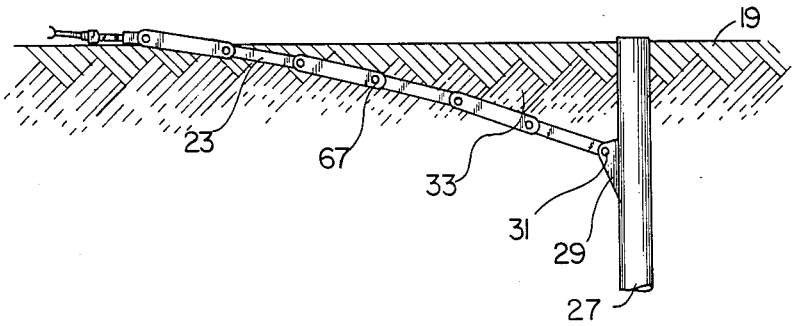
FIGS. 4A & 4B show a detail of the anchoring system of this invention, proximate the anchoring ground.
Figure 4B:
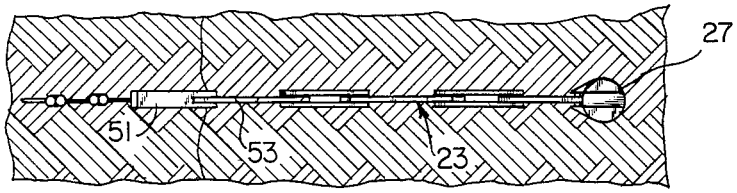

The second section 23 of the anchor line system 11 extends between the intermediate sinker cable section 25 and an anchor or anchor stake 27 which is embedded in the anchor ground 19. A detailed view of the second section 23 of the anchor line system 11 is presented in FIGS. 4A and 4B and the technique by which the anchor stake 27 is secured in the sea bed can be readily appreciated. The anchor stake 27 is a rod-like member with a plate or key 29 onto which a chain link according to this invention is secured by a pin or bolt 31 through a hole therein. The anchor stake 27 is driven into the anchor ground 19 such that the plate or key 29 and a predetermined number of chain links are disposed below the surface of the anchor ground 19 as at 33.

Figure 2:
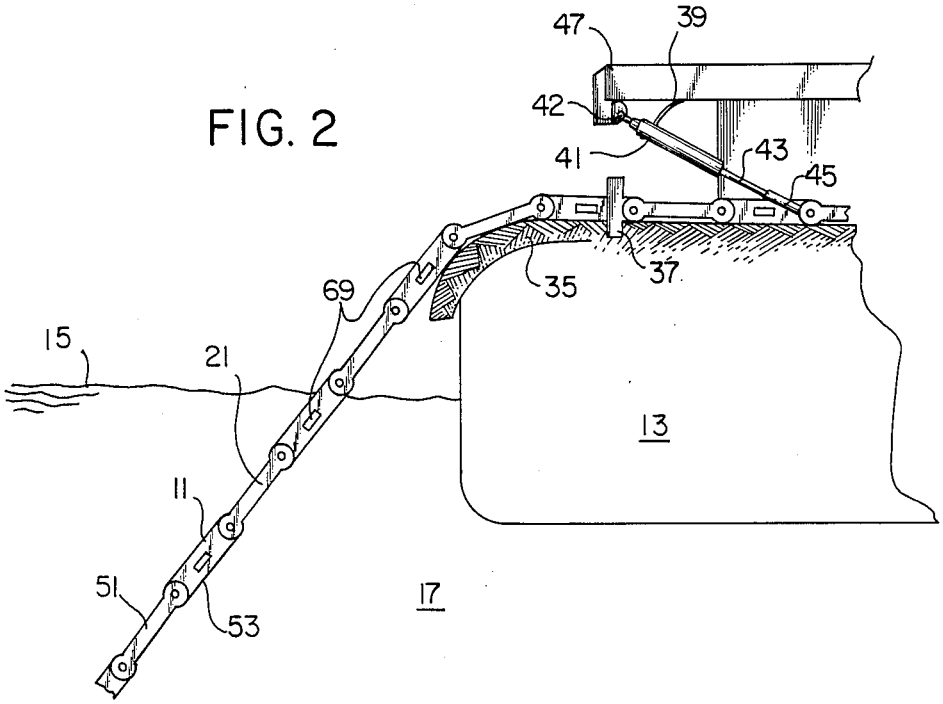
FIG. 2 is a detail of the present anchoring system proximate the floating structure and ocean surface.

The first section 21 of the anchor chain system 11 proximate the floating structure can be seen in greater detail in FIG. 2. The floating structure 13 includes an anchor chain track 35 adapted to receive therein and guide the anchor chain first section 21 from an anchor chain locker (not shown) on the floating structure 13 into the water 17. A chain stopper or devils claw 37 is operatively associated with the anchor chain track 35 in order to hold the chain system 11 at a desired position when, for example, the first section of the anchor chain 21 is engaged thereby. A chain shifting means 39 comprises a double acting hydraulic cylinder 41 with a piston and connecting rod 43 adapted to engage the chain system 11 with gripper means 45. The cylinder 41 is rotatably mounted at 42 to a structural support member 47 of the floating structure 13. In weighting the anchor or taking out the slack in the chain system 11, the double acting cylinder 41 is activated to engage the chain system 11 and draw it up along the chain track 35. When the maximum reach of the piston and connecting rod 43 is obtained and/or the desired chain position is obtained, the chain stopper 37, engages and holds the chain system 11 while the piston and connecting rod 43 retracts to engage another part of the chain system 11.

Figure 3:
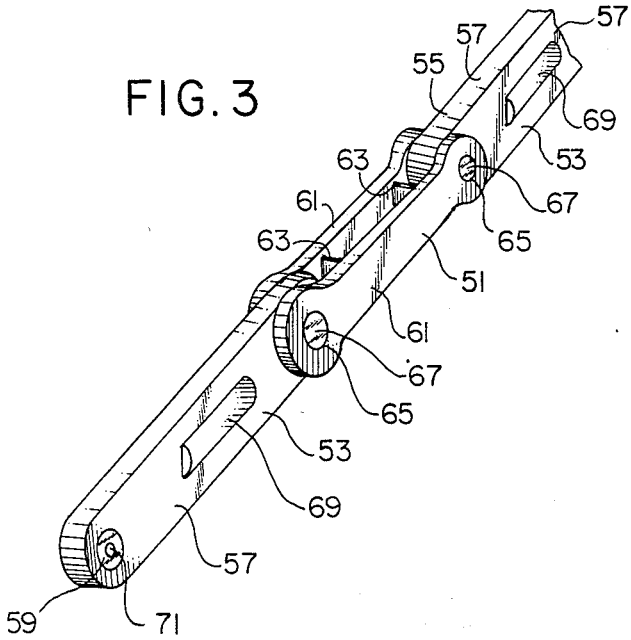
FIG. 3 is a perspective view of a section of the anchoring system according to the present invention.

Turning to FIG. 3, the anchor chain links, according to this invention, which links are preferably employed in the first section 21 of the anchor system 11, are shown in detail. The first, upper section 21 and preferably also the second, lower section 23 of the anchor chain system 11 comprise alternating double link members 51 and single link members 53. The single link member 53 comprises an elongated member 55 with opposed sides 57, at each end of which bores 59 are disposed. The double link members 51 comprise a pair of elongated members 61 held in a spaced relation by spacer bars 63 disposed therebetween. The double link members 51 can be cast as a single unit or the several components thereof welded together. At each end of each of the elongated members 61, a bore 65 is disposed so that the bores 65 are axially aligned with one another. The bores 65 of the double link member 51 and the bore 59 of the single link member 53 are aligned and transverse bolt means 67 is inserted therein to pivotably secure the individual links together. Each of the single link members 53 of the first section 21 preferably include an anode 69 attached near the center portion thereof as a protection against corrosion, particularly in the wet-dry region proximate the surface 15 of the water. Alternatively, the individual components of the anchor chain can be galvanized for protection against rust.

Figure 5:
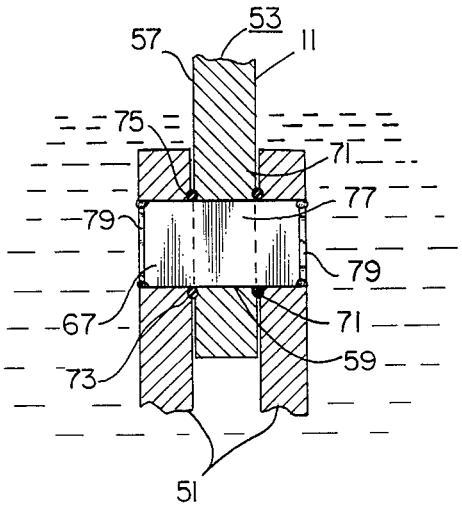
FIG. 5 is a sectional view of the anchoring chain.
Figure 5A:
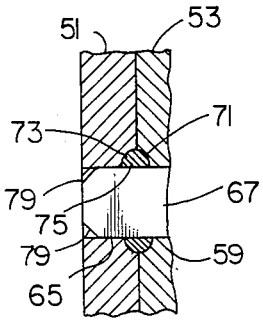
FIG. 5A shows in greater detail a portion of FIG. 5.

Turning to FIGS. 5 and 5A, the unique configuration by which the individual links are interconnected is shown in a sectional view of the transverse bolt means 67. Additionally, this configuration includes means designed to substantially eliminate negative environmental effects. A continuous circumferentially disposed groove 71 is formed about both the bores 59 of the single link members 53 on each of the opposed sides 57. Substantially identical, circumferentially disposed grooves 73 are formed about the bores 65 of the double link members 51. However, the grooves 73 need only be located on the opposed faces of the double link members 51. When the bores 59 and 65 of the individual link members 53 and 51 are aligned for bolt insertion, the grooves 71 and 73 combine to form a seat in which an 'O' ring or gasket means 75, preferably made of a rubber of plastic substance, is placed. The gasket means 75 protects the portion 77 of the bolt 67 about which the single link member 53 pivots. The external ends of the bolt as at 79 are welded to inhibit the possibility of adverse environment impact to the center portion 77 of the bolt 67.

What has been described is an anchoring system for floating structures in very deep water, which system is substantially protected from the harsh environmental impact of salt air and water, particularly in the wet-dry region adjacent the water's surface.

The invention, as described hereinabove in the context of a preferred embodiment, is not to be taken as limited to all of the provided details thereof, since, modifications and variations thereof may be made without departing from the spirit and scope of the invention.

What is claimed is:

1. An anchor system for anchoring a floating structure in deep waters, comprising: an anchor line extending from said floating structure to an anchor ground, said anchor line having a first section proximate said floating structure, a second section proximate said anchor ground and an intermediate section thereinbetween; wherein said anchor line first section comprises an anchor chain assembly having a plurality of single link members having bores at each end thereof and a plurality of double link members also having bores at each end thereof to match said single link member bores in said chain assembly, said bores having internal surfaces; said single link members and said double link members being alternately disposed adjacent to one another in said chain assembly; said anchor chain assembly including transverse bolt means operatively associated in assembly with said bores of said single link members and said double link members to pivotably secure said adjacent link members together to form a chain; said transverse bolt means having a shank portion, said shank portion having a surface which directly bears on said internal bore surfaces in said link members, wherein said anchor line intermediate section comprises a sinker cable having a plurality of interconnected weights associated therewith, and wherein said anchor line first section includes means for sealing said shank surface to prevent water ingress to said shank surface, wherein further each said single link member comprises an elongated member with said bores being disposed proximate each end thereof, said elongated member including opposed sides having a circumferentially disposed groove formed about each of said bores on both said opposed sides, and wherein each said double link member comprises a pair of elongated members with said bores at each end of said pair of elongated members being disposed proximate each other, said pair of elongated members being held in a spaced relation by said single link members disposed thereinbetween, said double link members including a pair of facing sides having a circumferentially disposed groove formed about each said bore, said anchor chain assembly including circumferential gasket seats which are defined and formed by said circumferentially disposed grooves, said means for sealing further comprising "O"-ring gasket means disposed in said circumferential gasket seats.

2. The anchor system according to claim 1 wherein said anchor line second section adjacent to said anchor ground includes an anchor stake embedded in said anchor ground, said anchor stake having means for interconnecting said anchor line second section with said anchor stake.

3. The anchor system according to claim 1 wherein said transverse bolt means include fillets welded to said double link members, and wherein said weld fillets, in combination with said gasket means, substantially protect said transverse bolt means, about which said single link members pivot, from environmental impact.

4. The anchor system according to claim 1 wherein said anchor line first section is galvanized, wherein said means for sealing to prevent water ingress to said shank surface further comprises O-ring gasket means being disposed between said shank surface and said bores in said single and double link members, and wherein said anchor line first section includes weld fillets disposed between ends of said bolt means and adjacent said double link members.

5. The anchor system according to claim 1 wherein a plurality of anodes are disposed along said anchor line first section.

6. The anchor system according to claim 3 wherein said anchor line first section is galvanized.

7. The anchor system according to claim 3 wherein a plurality of anodes are disposed along said anchor line first section.

8. The anchor system according to claim 5 wherein said anodes are disposed on said single link members.

9. An anchor system for anchoring a floating structure in deep waters, comprising: an anchor line extending from said floating structure to an anchor ground, said anchor line having a first section proximate said floating structure, a second section proximate said anchor ground and an intermediate section thereinbetween; wherein said anchor line first section and said anchor line second section comprise an anchor chain assembly including a plurality of single link members having bores at each end thereof and a plurality of double link members also having bores at each end thereof, said bores having an internal surface; said single link members and said double link members being alternately disposed relative to one another in said chain assembly; said anchor chain assembly including transverse bolt means operatively associated with said bores of adjacent link members to pivotably secure said adjacent link members together, said transverse bolt means having a shank portion, said shank portion having a surface which directly bears on said internal bore surfaces in said link members, said anchor line first section and said anchor line second section including means for sealing said shank surface from exposure to atmospheric elements, said means for sealing including gasket means in the form of "O"-rings, said "O"-rings being disposed between said shank surface and said bores, and wherein said bores in said link members include annular recesses which, on assembly of said link members, form circumferential grooves to accommodate said "O"-rings, each said circumferential groove being disposed in a plane where said single link members and said double link members contact, said anchor line chain assembly also including weld fillets at both ends of each said transverse bolt means, said weld fillets being disposed between each said bolt end and an associated said second link member.

10. The anchor system according to claim 9 wherein said anchor line intermediate section comprises a sinker cable having a plurality of interconnected weights associated therewith.

11. The anchor system according to claim 9 wherein said anchor line second section adjacent said anchor ground includes an anchor stake embedded in said anchor ground, said anchor stake having means for interconnecting said anchor line second section with said anchor stake.

12. The anchor system according to claim 9 wherein said transverse bolt means are welded to said double link members to form weld fillets, and wherein said weld fillets, in combination with said gasket means, substantially protect said shank portion, about which said single link members pivot, from environmental impact.

* * * * *